US006494816B1

(12) United States Patent
Corrado

(10) Patent No.: US 6,494,816 B1
(45) Date of Patent: Dec. 17, 2002

(54) FOOT, LEG AND LOWER BODY EXERCISE SYSTEM

(76) Inventor: Pasquale A. Corrado, 497 - 79th St. South, St. Petersburg, FL (US) 33779

( * ) Notice: Subject to any disclaimer, the term of this patent is extended or adjusted under 35 U.S.C. 154(b) by 0 days.

(21) Appl. No.: 09/784,741

(22) Filed: Feb. 15, 2001

(51) Int. Cl.[7] ..... A63B 23/00

(52) U.S. Cl. ..... 482/79; 482/51; 482/54; 482/70

(58) Field of Search ..... 482/70, 74, 52, 482/111, 908, 66, 51, 53

(56) References Cited

U.S. PATENT DOCUMENTS 2,720,396 A * 10/1955 Pfaus ..... 482/70
4,685,666 A * 8/1987 De Cloux ..... 482/70
5,279,531 A * 1/1994 Jen Huey ..... 482/70

* cited by examiner

*Primary Examiner*—Jerome W. Donnelly

(57) ABSTRACT

A foot, leg and lower body exercise system comprising a housing having a generally rectangular configuration. The housing comprises an upper plate and lower plate. There are also two side plates and two end plates there between. The length of the housing is greater than the width of the housing. The width is greater than the height. The housing has two equally configured rectangularly shaped openings in the upper plate. Each of the openings has a slot along each of the long edges of the rectangular shaped openings. There is further provided a pair of foot slides mated to the upper plate and a foot rest mated with rectangular slots of the base plate. The system also comprises a reciprocating mechanism to allow the forward and rearward motion of the foot slides.

6 Claims, 4 Drawing Sheets

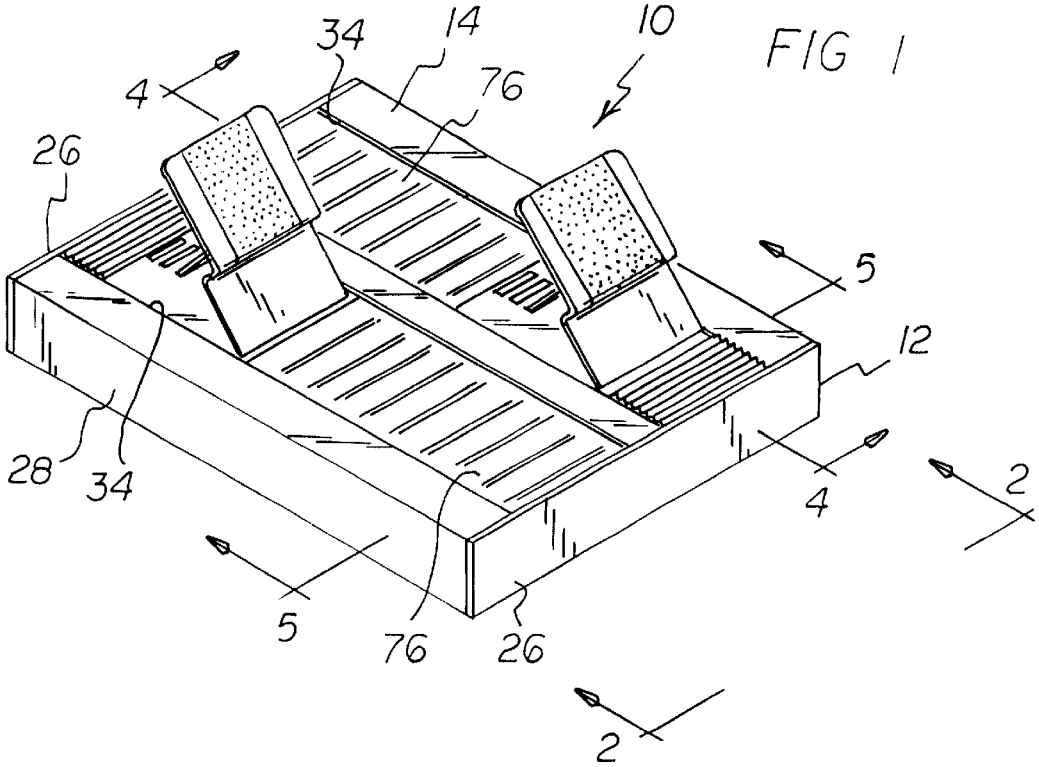
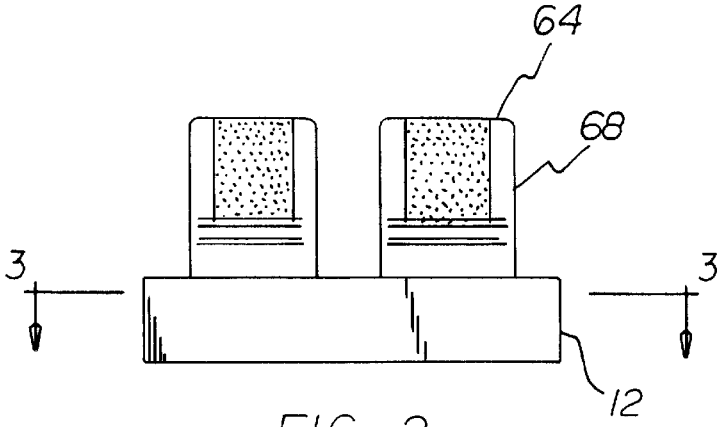
FIG 2

FIG 3
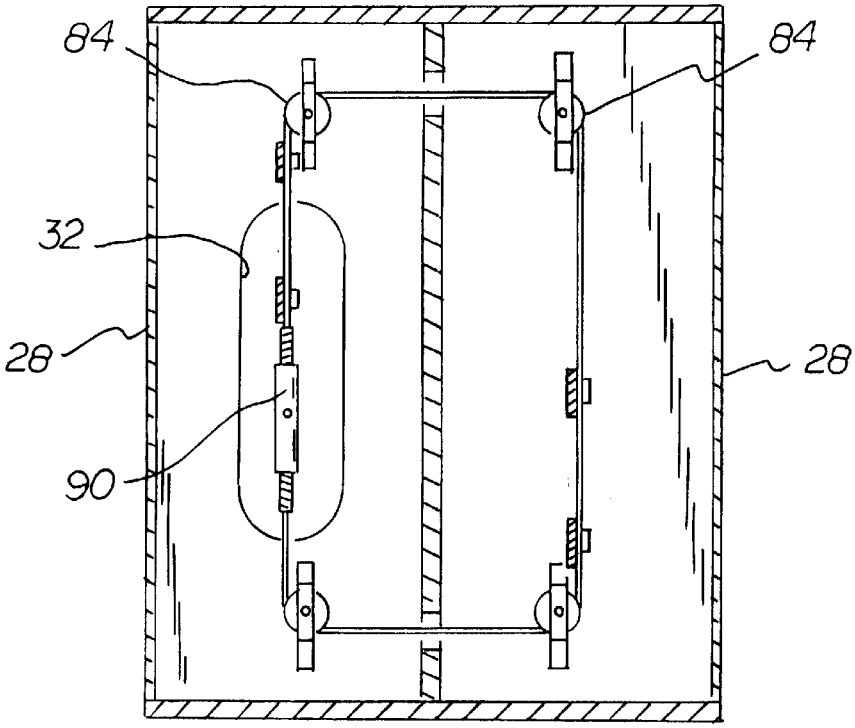
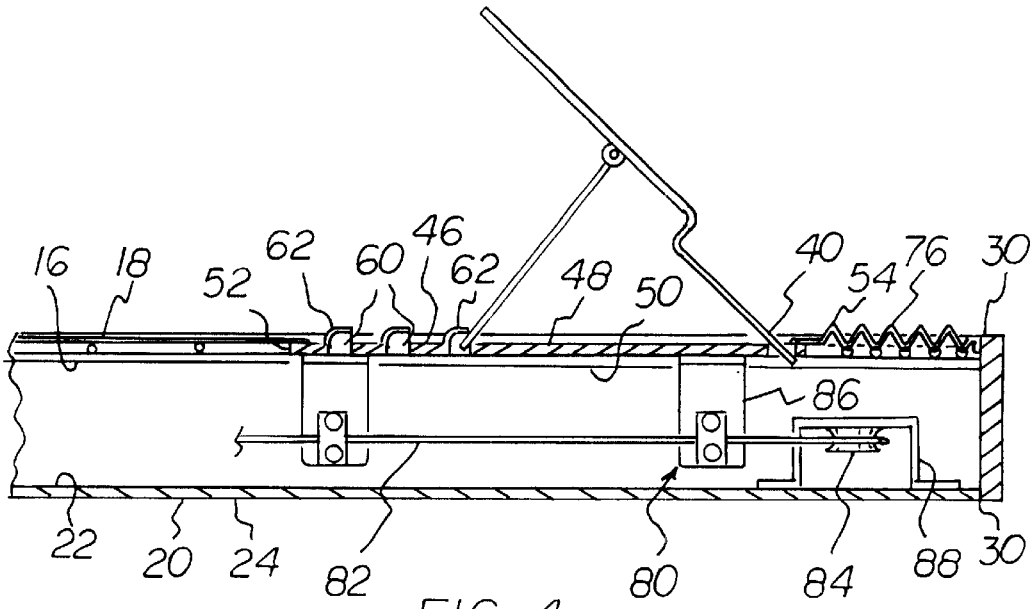
FIG 4

FIG 5
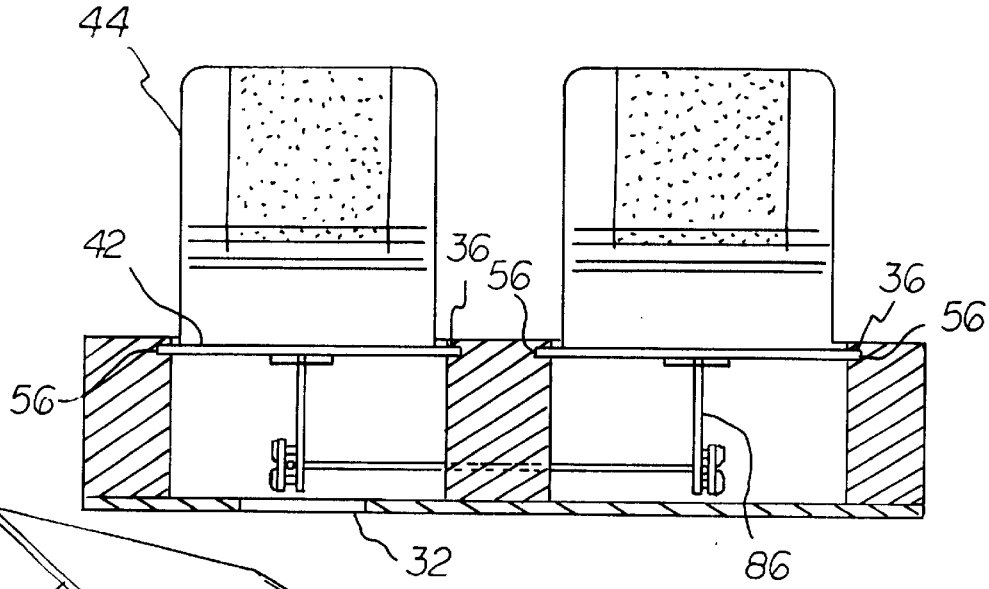
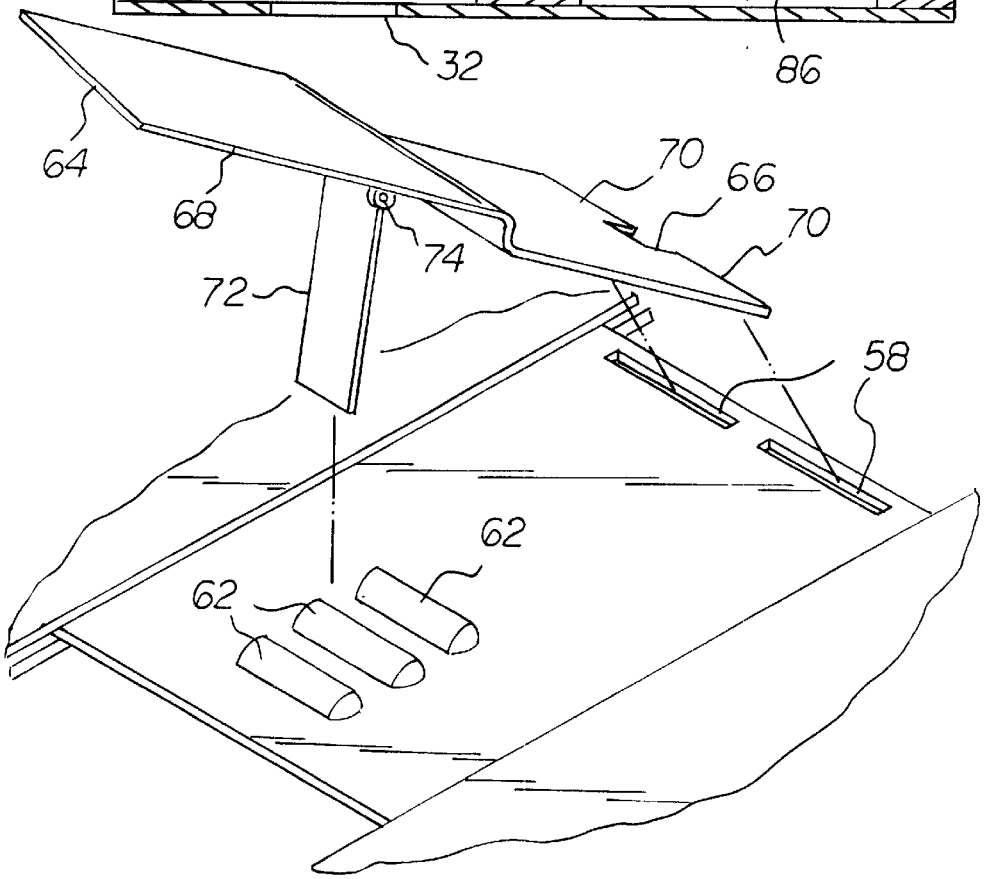
FIG 6

FOOT, LEG AND LOWER BODY EXERCISE SYSTEM

BACKGROUND OF THE INVENTION

1. Field of the Invention

The present invention relates to a foot, leg and lower body exercise system and more particularly pertains to a system to safely and efficiently provide exercise for a user's feet and legs.

2. Description of the Prior Art

The use of other known means and apparatuses for the exercise of a user's legs, feet and lower body is known in the prior art. More specifically, other known means and apparatuses for the exercise of a user's legs, feet and lower body previously devised and utilized for the purpose of providing exercise for the user's legs, feet and lower body are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,807,212 to Nelson discloses a leg exerciser for use under a desk. U.S. Pat. No. 5,749,668 to McIlvain et al discloses an apparatus for the rehabilitation of an ankle. U.S. Pat. No. 4,813,667 to Watterson discloses a multipurpose exerciser. Lastly, U.S. Pat. No. 4,434,981 to Norton discloses a cross country skiing simulating exerciser.

While these devices fulfill their respective, particular objectives and requirements, the aforementioned patents do not describe foot, leg and lower body exercise system that allows for safely and efficiently providing exercise for a user's feet, legs and lower body.

In this respect, the foot, leg and lower body exercise system according to the present invention substantially departs from the conventional concepts and designs of the prior art, and in doing so provides an apparatus primarily developed for the purpose of safely and efficiently providing exercise for a user's feet, legs and lower body.

Therefore, it can be appreciated that there exists a continuing need for a new and improved foot, leg and lower body exercise system which can be used for safely and efficiently providing exercise for a user's feet, legs and lower body. In this regard, the present invention substantially fulfills this need.

SUMMARY OF THE INVENTION

In view of the foregoing disadvantages inherent in the known types of other known means and apparatuses now present in the prior art, the present invention provides an improved foot, leg and lower body exercise system. As such, the general purpose of the present invention, which will be described subsequently in greater detail, is to provide a new and improved foot, leg and lower body exercise system and method which has all the advantages of the prior art and none of the disadvantages.

To attain this, the present invention essentially comprises a foot, leg and lower body exercise system for safely and efficiently providing exercise for a user's feet, legs and lower body. The system comprises, in combination, several components. First there is provided a housing. The housing has an upper plate with an inside and an outside, and a lower plate with an inside and an outside. There are also provided two end plates and two side plates there between. The end plates and side plates are oriented perpendicular to the plane of the upper and lower plates. The end and side plates are coupled to the edges of the upper and lower plates thereby forming a generally rectilinear configuration. The length of the housing is greater than the width of the housing. The width to height ratio of the housing is about 7:1. The lower plate has an adjustment aperture located to one side of the lower plate. The upper plate has two equally configured rectangularly shaped openings. Each of the rectangularly shaped openings are equally spaced from the side edges of the upper plate. Each of the openings has a recess along each of the long edges of the rectangularly shaped openings. There is next provided a pair of like configured foot slides. Each slide has a rigid portion comprising a foot rest and a base plate. The base plate has an upper face and a lower face. The base plate has a flat rectangular configuration with forward and rearward edges, as well as side edges there between. Slots are provided adjacent to the rearward edge of each base plate. The side edges of the base plate are configured to be slidably mated to the recesses of the openings of the upper plate so as to provide positive tracking along the recesses in a forward and rearward movement. Each base plate has a plurality of rectangular apertures on the upper face. These apertures are located adjacent to the forward edge. Also provided are a plurality of upstanding protuberances located on the upper face of the base plate across the midline. The foot rest has an upper end and a lower end with two side edges there between. The foot rest is configured in a generally "Z" shaped form. There are provided two wide prongs extending from the lower end of the foot rest to be receivably loosely mated with the slots of the base plate. The foot rest also has a downwardly extending locking arm which is rotatably coupled to the underside of the foot rest and is capable of being securely retained by any one of the protuberances of the base plate. This allows for the foot rest to be maintained in any of a plurality of angles. There is next provided a collapsible portion of the foot slides. The collapsible portion is operatively coupled to each foot slide and also coupled to the base plate at the side ends of the base plate. The peripheral edges of the collapsible portion are coupled to the inside of the housing top thereby closing off the openings during reciprocation of the foot rests and base plates. There is next provided a reciprocating mechanism comprising a flexible pulley cable, a plurality of pulleys, a plurality of mounting brackets and a plurality of housing brackets. The pulleys are oriented in a rectangular configuration within the confines of the housing. The axes of the pulleys are located along the first and second quarter dividing line of the long axis of the lower plate and the third and fourth quarter dividing line of the long axis of the lower plate. The pulleys are rotatably coupled to, and mounted on, the fixed mounting brackets. The mounting brackets in turn are coupled to the inside of the lower plate. The mounting brackets also couple the flexible pulley cable to the lower face of the base plate of the foot slides. This coupling between the foot slides through the cable and pulleys allows the foot slides to reciprocate forwardly and rearwardly. This allows for a reciprocating motion of the foot slides. Lastly there is provided an adjustment turnbuckle which is coupled to the pulley cable to form a continuous loop. The adjustment turnbuckle is located within the housing. The turnbuckle is accessible through the adjustment aperture of the lower plate to thereby vary the tension of the cable during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot, leg and lower body exercise system which has all of the advantages of the prior art other known means and apparatuses and none of the disadvantages.

It is another object of the present invention to provide a new and improved foot, leg and lower body exercise system which may be easily and efficiently manufactured and marketed.

It is a further object of the present invention to provide a new and improved foot, leg and lower body exercise system which is of durable and reliable constructions.

An even further object of the present invention is to provide a new and improved foot, leg and lower body exercise system which is susceptible of a low cost of manufacture with regard to both materials and labor, and which accordingly is then susceptible of low prices of sale to the consuming public, thereby making such foot, leg and lower body exercise system economically available to the buying public.

Even still another object of the present invention is to provide a foot, leg and lower body exercise system for safely and efficiently providing exercise for a user's feet, legs and lower body.

Lastly, it is an object of the present invention to provide a new and improved foot, leg and lower body exercise system comprising a housing having a generally rectilinear configuration. The housing comprises an upper plate and lower plate. There are also two side plates and two end plates there between. The length of the housing is greater than the width of the housing. The width is greater than the height. The housing has two equally configured rectangularly shaped openings in the upper plate. Each of the openings has a slot along each of the side edges of the rectangularly shaped openings. There is further provided a pair of foot slides mated to the upper plate and a foot rest mated with the rectangular slots of the base plate. The system also comprises a reciprocating mechanism to allow the forward and rearward motion of the foot rests.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the foot, leg and lower body exercise system.

FIG. 2 is a front elevation view taken along line 2—2 of FIG. 1.

FIG. 3 is a cross sectional view of the foot, leg and lower body exercise system taken along line 3—3 of FIG. 1.

FIG. 4 is a side elevation of the foot, leg and lower body exercise system taken along line 4—4 of FIG. 1.

FIG. 5 is a cross sectional view taken along line 5—5 of FIG. 1.

FIG. 6 is an exploded view of the foot plate and slide of the foot, leg and lower body exercise system of FIG. 1.

The same reference numerals refer to the same parts throughout the various Figures.

DESCRIPTION OF THE PREFERRED EMBODIMENT

Figure 7:
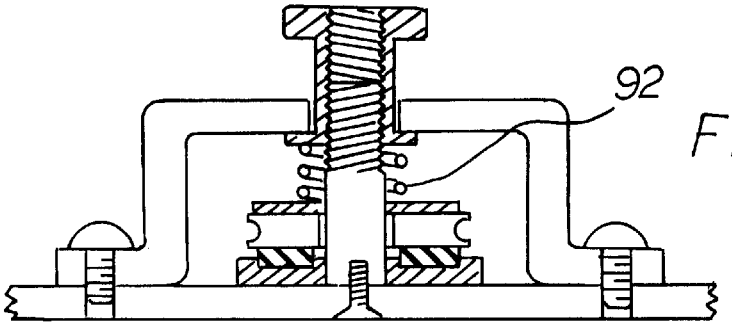
FIG. 7 is a cross sectional view of the mechanical resistance device employed in an alternate embodiment of the invention.
Figure 8:
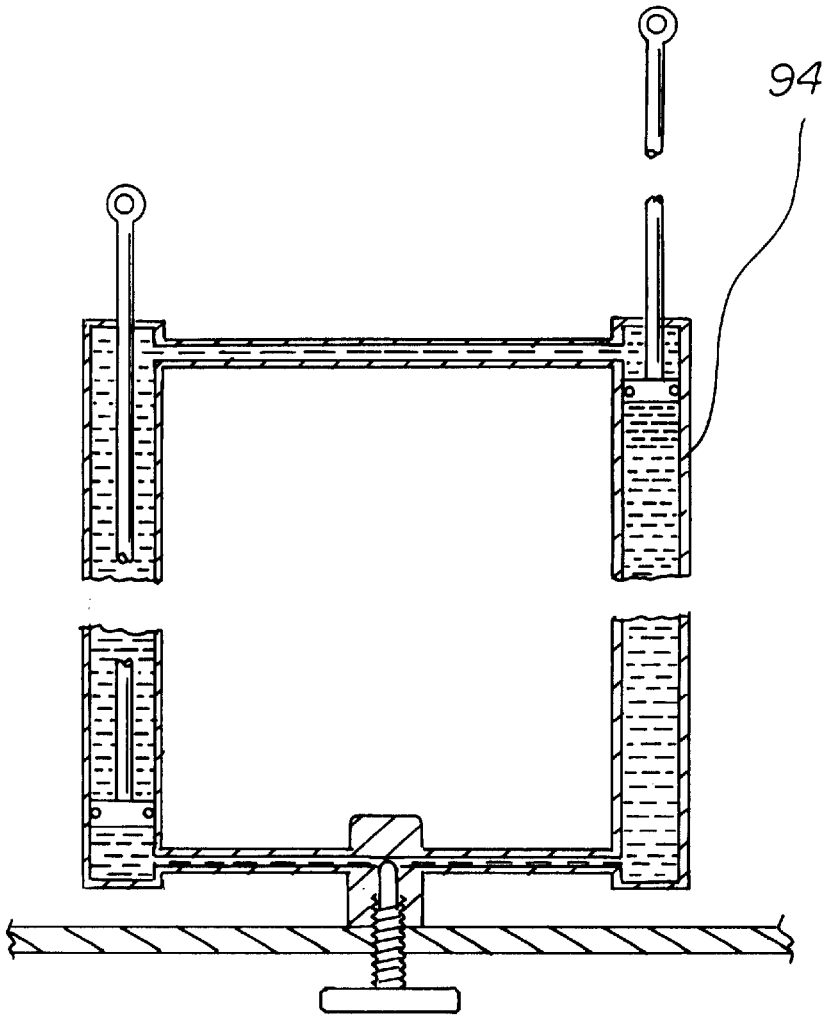
FIG. 8 is a cross sectional view of a hydraulic resistance device of the foot, leg and lower body exercise system employed in another alternate embodiment of the invention.

With reference now to the drawings, and in particular to FIG. 1 thereof, the preferred embodiment of the new and improved foot, leg and lower body exercise system embodying the principles and concepts of the present invention and generally designated by the reference numeral 10 will be described.

The present invention, the foot, leg and lower body exercise system 10 is comprised of a plurality of components. Such components in their broadest context include a housing, a pair of slides, a pulley system and a cable. Such components are individually configured and correlated with respect to each other so as to attain the desired objective.

A foot, leg and lower body exercise system 10 safely and efficiently provides exercise for a user's feet, legs and lower body. The system also provides for cardiovascular benefits. The system comprises, in combination, several components. First there is provided a housing 12. The housing has an upper plate 14 with an inside 16 and an outside 18, and a lower plate 20 with an inside 22 and an outside 24.

There are also provided two end plates 26 and two side plates 28 there between. The end plates and side plates are oriented perpendicular to the plane of the upper and lower plates. The end and side plates are coupled to the edges 30 of the upper and lower plates thereby forming a generally rectilinear configuration. The length of the housing is greater than the width of the housing. The width is greater than the height with a width-to-height ratio of about 7:1.

The lower plate has an adjustment aperture 32 located to one side of the lower plate. The upper plate has two equally configured rectangularly shaped openings 34. Each of the rectangularly shaped openings are equally spaced from the side edges of the upper plate. Each of the openings has a recess 36 along each of the long edges of the rectangular shaped openings.

There is next provided a pair of like configured foot slides 40. Each slide has a rigid portion 42 comprising a foot rest 44 and a base plate 46. The base plate has an upper face 48 and a lower face 50. The base plate has a flat rectangular configuration with forward 52 and rearward edges 54, as well as side edges 56 there between. Slots 58 are provided adjacent to the rearward edge of each base plate. The side edges of the base plate are configured to be slidably mated to the recesses of the openings of the upper plate so as to provide positive tracking along the recesses in a forward and rearward movement. Each base plate has a plurality of rectangular apertures 60 on the upper face. These apertures are located adjacent to the forward edge.

There are also provided a plurality of upstanding protuberances 62 located on the upper face of the base plate across the midline. Each foot rest has an upper end 64 and a lower end 66 with two side edges 68 there between. The foot rest is configured in a generally "Z" shaped form with two planar sections and two right angle bends there between. There are provided two wide prongs 70 extending from the lower end of the foot rest to be receivably loosely mated with the rectangular slots of the base plate. The foot rest also has a downwardly extending locking arm 72. A rotatable coupling 74 is provided on the underside of the foot rest. The locking arm is capable of being securely retained by any one of the protuberances of the base plate. This allows the foot rest to be maintained in any of a plurality of angles to suit a user.

There is next provided a collapsible portion 76 of the foot slides. The collapsible portion is operatively coupled to each foot slide and also coupled to the base plate adjacent to the side edges of the base plate. The peripheral edges of the collapsible portion are coupled to the inside of the top plate of the housing. This closes off the openings during reciprocation of the foot rests and base plates.

There is next provided a reciprocating mechanism 80 comprising a flexible pulley cable 82, a plurality of pulleys 84, a plurality of mounting brackets 86 and a plurality of housing brackets 88. The pulleys are oriented in a rectangular configuration within the confines of the housing. The axes of the pulleys are located along the first and second quarter dividing line of the long axis of the lower plate and the third and fourth quarter dividing line of the long axis of the lower plate. The pulleys are rotatably coupled to, and mounted on, the fixed mounting brackets. The mounting brackets in turn are coupled to the inside of the lower plate. The mounting brackets also couple the flexible pulley cable to the lower face of the base plate of the foot slides. This coupling between the foot slides through the cable and pulleys allows the foot slides to reciprocate forwardly and rearwardly.

Lastly there is provided an adjustment turnbuckle 90 which is coupled to the pulley cable to form a continuous loop formed by the cable and turnbuckle. The adjustment turnbuckle is located within the housing. The turnbuckle is accessible through the adjustment aperture of the lower plate to thereby vary the tension of the cable during operation and use.

In an alternate embodiment of the invention the pulley reciprocating mechanism comprises a resistance device 92. The device is threadedly adjusted to increase and decrease the resistance to operation at the discretion of the user.

In another alternate embodiment of the invention, a hydraulic resistance system 94 is provided. The hydraulic resistance system has a fixed tubing supporting a fluid and associated plungers coupled to the foot slides. Such arrangement is used in place of the pulley configuration. Movement of the foot slides moves the pistons back and forth. A bolt extends into the path of flow of the fluid to restrict and resist the reciprocating movement of the slides to an extent as desired by the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot, leg and lower body exercise system for safely and efficiently providing exercise for a user's feet, legs and lower body comprising, in combination;

a housing, having an upper plate with an inside and an outside, and a lower plate with an inside and an outside, and with two end plates and two side plates there between, the end plates and side plates being oriented perpendicular to the plane of the upper and lower plates and with the end and side plates being coupled to the edges of the upper and lower plates, thereby forming a generally rectilinear configuration with the length of the box being greater than the width of the box and with the width to height ratio being about 7:1, with the lower plate being formed with an adjustment aperture located to one side of the lower plate, the upper plate having two equally configured rectangularly shaped openings, each opening being equally spaced from the side edges of the upper plate, each of the openings also having a recess along each of the side edges of the rectangularly shaped openings;

a pair of like configured foot slides with each slide having a rigid portion comprising a foot rest and a base plate, the base plate having an upper face and a lower face and having a flat rectangular configuration with forward and rearward edges and side edges there between and with slots adjacent to the rearward edge of each base plate, the side edges of the base plate being configured to be slidably mated to the recesses of the openings of the upper plate so as to provide positive tracking along the recesses in a forward and rearward movement, each base plate having a plurality of rectangular apertures on the upper face and located adjacent to the forward edge with a plurality of up standing protuberances being located on the upper face of the base plate across the midline, each foot rest having an upper end and a lower end with two side edges there between, each foot rest being configured in a generally "Z" shaped form with two wide prongs extending from the lower end to be receivably loosely mated with the rectangular slots of the base plate, the foot rest also having a downwardly extending locking arm which is rotatably coupled to the underside of the foot rest and capable of being securely retained by the any one of the protuberances of the base plate thereby allowing for the foot rest to be maintained in any of a plurality of angles;

the collapsible portion operatively coupled to each foot slide and also being coupled to the base plate at the side edges of the base plate with the peripheral edges of the collapsible portion being coupled to the inside of the top plate of the housing thereby close off the openings during reciprocation of the foot rests and base plates;

a reciprocating mechanism comprising a flexible pulley cable, a plurality of pulleys, a plurality of mounting brackets and a plurality of housing brackets, the pulleys being oriented in a rectangular configuration within the confines of the housing with the axes of the pulleys being located along the first and second quarter dividing line of the long axis of the lower plate and the third and fourth quarter dividing line of the long axis of the lower plate and the pulleys being rotatably coupled to, and mounted on, the fixed mounting brackets, the mounting brackets in turn being coupled to the inside of the lower plate, the mounting brackets also coupling the flexible pulley cable to the lower face of the base plate of the foot slides thereby allowing the foot slides to reciprocate forwardly and rearwardly; and an adjustment turnbuckle coupled to the pulley cable to form a continuous loop with the adjustment turnbuckle being located within the housing so that the turnbuckle is accessible through the adjustment aperture of the lower plate to thereby vary the tension on the cable during operation and use.

2. A foot, leg and lower body exercise system comprising;

a housing having a generally rectilinear configuration with an upper plate and lower plate and side and end plates there between, the length of the housing being greater than the width of the housing and with the height being greater than the width, the housing having two equally configured rectangularly shaped openings in the upper plate, each of the openings having a slot along each of the long edges of the rectangularly shaped openings;

a pair of foot slides mated to the upper plate and a foot rest mated with rectangular slots of the base plate;

a reciprocating mechanism for the forward and rearward reciprocating movement of the foot slides; and a collapsible portion operatively coupled to the front and back of each foot slide and also being coupled to the upper plate of the housing with each collapsible portion having peripheral edges coupled to the inside of the upper plate of the housing thereby closing off the openings during reciprocation of the foot slides.

3. A foot, leg and lower body exercise system as described in claim 2 wherein the reciprocating mechanism comprises a plurality of pulleys, a plurality of mounting brackets, a plurality of housing brackets and a pulley cable.

4. A foot, leg and lower body exercise system as described in claim 3 wherein the pulley reciprocating mechanism further comprises variable resistance device to modify the amount of resistance which is felt by the user during the reciprocating forward and rearward motions of the system.

5. A foot, leg and lower body exercise system as described in claim 2 wherein the reciprocating mechanism comprises a system of a plurality of hydraulic tubings and plungers wherein the resistance felt by the user during the forward and rearward movement of the foot, leg and lower body exercise system is determined by the hydraulic resistance of the reciprocating mechanism.

6. A foot, leg and lower body exercise system as described in claim 2 wherein the upper plate has a plurality of protuberances adjacent to each slot and the foot slides each have a downwardly extending locking arm which is rotatably coupled to the underside of the foot slide and capable of being securely retained by any one of the protuberances of the upper plate thereby allowing for each foot slide to be maintained in any of a plurality of angles.

* * * * *